United States Patent [19]

Box

[11] 3,998,328

[45] Dec. 21, 1976

[54] FULL DEPTH BEVERAGE CASE

[76] Inventor: Theodor M. Box, 1108 Aileen Road, Brielle, N.J. 08730

[22] Filed: Apr. 14, 1975

[21] Appl. No.: 567,821

[52] U.S. Cl. ..... 206/511; 220/21; 220/72

[51] Int. Cl.[2] ..... B65D 1/24; B65D 21/02

[58] Field of Search ..... 220/21, 23.6, 72; 206/203, 427, 503, 509, 511, 512

[56] References Cited

UNITED STATES PATENTS

| | | | |
|---|---|---|---|
| 3,341,064 | 9/1967 | Ricci | 206/512 |
| 3,361,293 | 1/1968 | Box | 206/511 |
| 3,380,616 | 4/1968 | Schoeller | 220/21 |
| 3,432,063 | 3/1969 | Schoeller | 220/21 |
| 3,568,879 | 3/1971 | Box | 206/511 X |
| 3,628,684 | 12/1971 | Sere | 220/21 |
| 3,655,088 | 4/1972 | Box | 206/427 X |
| 3,701,449 | 10/1972 | Schoeller | 220/21 |
| 3,802,595 | 4/1974 | Frahm et al. | 206/511 X |

FOREIGN PATENTS OR APPLICATIONS

| | | | |
|---|---|---|---|
| 260,785 | 3/1968 | Austria | 220/21 |
| 1,328,343 | 4/1963 | France | 220/21 |
| 1,404,289 | 5/1965 | France | 220/23.6 |
| 1,084,191 | 9/1967 | United Kingdom | 220/21 |

*Primary Examiner*—William Price
*Assistant Examiner*—Stephen Marcus

[57] ABSTRACT

A rectangular full depth case for bottled beverages of unitary molded plastic construction has windows in both side panels and end panels to permit identification of the contents of the case. Interior vertical strengthening ribs extending inwardly from the side panels at spaced intervals run from the bottom of the case to just below an upper stacking rim for supporting the weight of additional cases stacked on top in criss-cross fashion for palletized loading. Strengthening column members of hollow substantially triangular cross section at the junctions of the side panels and the end panels provide both vertical strength and resistance to racking, while presenting a clean design. Criss-cross partitions extend upwardly from the bottom of the case for less than half its height to create separate bottle-receiving compartments.

3 Claims, 9 Drawing Figures

FULL DEPTH BEVERAGE CASE

BACKGROUND OF THE INVENTION

The present invention relates to transport cases for beverage bottles and, in particular, to full depth beverage cases.

Full depth cases surround the bottles for their full height, thereby providing improved protection against breakage and permitting the cases to be stacked without placing any load on the bottles themselves. Formerly, such cases were made of wood or metal, but now, increasingly, they are being integrally molded from synthetic, high impact strength, plastic material such as high density polyethylene, polypropylene, polyvinyl chloride and the like.

An example of such a case is shown in my U.S. Pat. No. 3,568,879, issued Mar. 9, 1971, for a plastic stacking and transport case. A feature of the case in that patent is a bottom designed for easy and rapid locking engagement and disengagement between layers of cases stacked on shipping pallets in criss-cross fashion.

In criss-cross stacking, the cases of one layer are set across the tops of the cases of the layer underneath; so that each case in one layer bridges across at least two cases in the layer underneath. Criss-crossing produces a firmly interlocked stack of cases that acts as a monolithic unit on the pallet.

A drawback of conventional full depth beverage cases is the difficulty in identifying the contents of the bottles in the cases, particularly in stacked cases, because the labels are hidden behind the side and end panels. When the cases are criss-cross stacked, the weight of the upper cases is not carried by the corners of the bottom cases but must be supported by the side and end panels at points between the corners. Thus, these panels are normally formed with solid walls or with closely spaced latticework to provide the necessary vertical strength to the upper margins of the panels.

SUMMARY OF THE INVENTION

It is a primary object of the present invention to provide a full depth beverage case that gives maximum bottle label visibility without sacrificing the sidewall strength necessary to permit criss-cross palletizing.

It is another object of the invention to provide a unitary full depth beverage case having windows in the side and end panels yet with strength and rigidity equal to or exceeding prior art cases.

These and other objects are attained in a full depth beverage case comprising a bottom, with two end panels and two side panels joined to one another and to said bottom. The side and end panels are equipped with windows to permit identification of bottles contained in the case. Strengthening ribs extend inwardly from the side panels at spaced positions and run from the bottom of the case to terminate below the tops of the panels, and strengthening column members extend from the bottom to the top of the case along the junctions of the side and end panels.

Preferably, the case is of unitary molded plastic construction and includes upper and lower continuous stacking rims around the top and bottom edges, respectively. The case may also include interior criss-cross partitions extending upwardly from the bottom for less than half the depth of the case to provide separate bottle-receiving compartments.

To provide strength and rigidity with minimum weight, the column members at the junctions of the side and end panels are hollow, preferably of triangular cross section. The windows in the side and end panels are desirably arranged as upper and lower windows corresponding in height and vertical extent to the usual neck and side labels, respectively, of beverage bottles. The interior strengthening ribs comprise a pair of tapered ribs for each side panel extending to below the upper stacking rim and a third such rib disposed between each pair but terminating short of the respective upper window.

The resulting case is lightweight yet extremely strong and rigid, as will be more fully apparent from the following description of the preferred embodiment illustrated in the accompanying drawings.

DESCRIPTION OF THE PREFERRED EMBODIMENT

Figure 1:
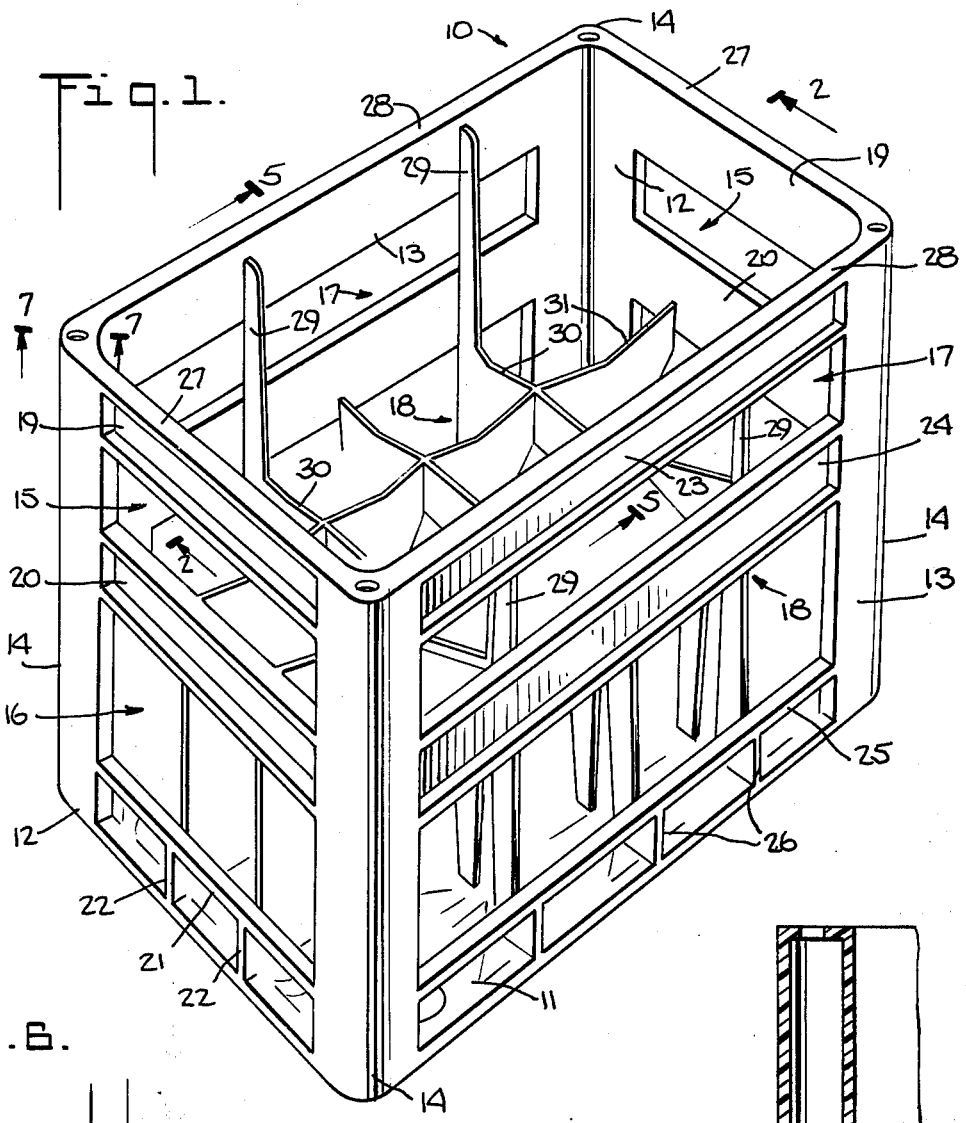
FIG. 1 is a top perspective view of a full depth case partitioned for one dozen beverage bottles.
Figure 2:
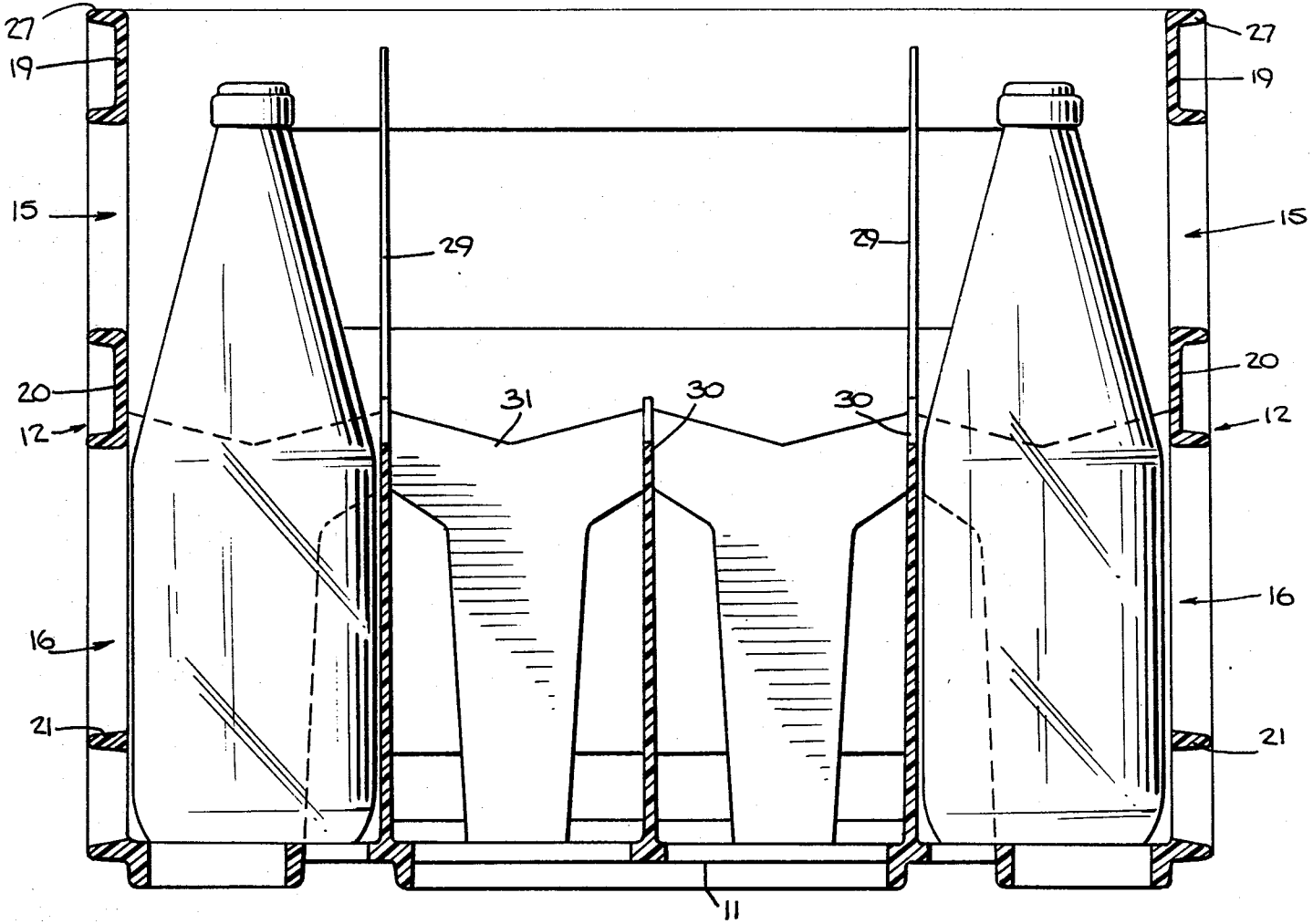
FIG. 2 is a sectional elevation view taken on line 2—2 of FIG. 1 and including two bottles to show the relative height of case and bottles and to illustrate the visibility possible through the windows.
Figure 5:
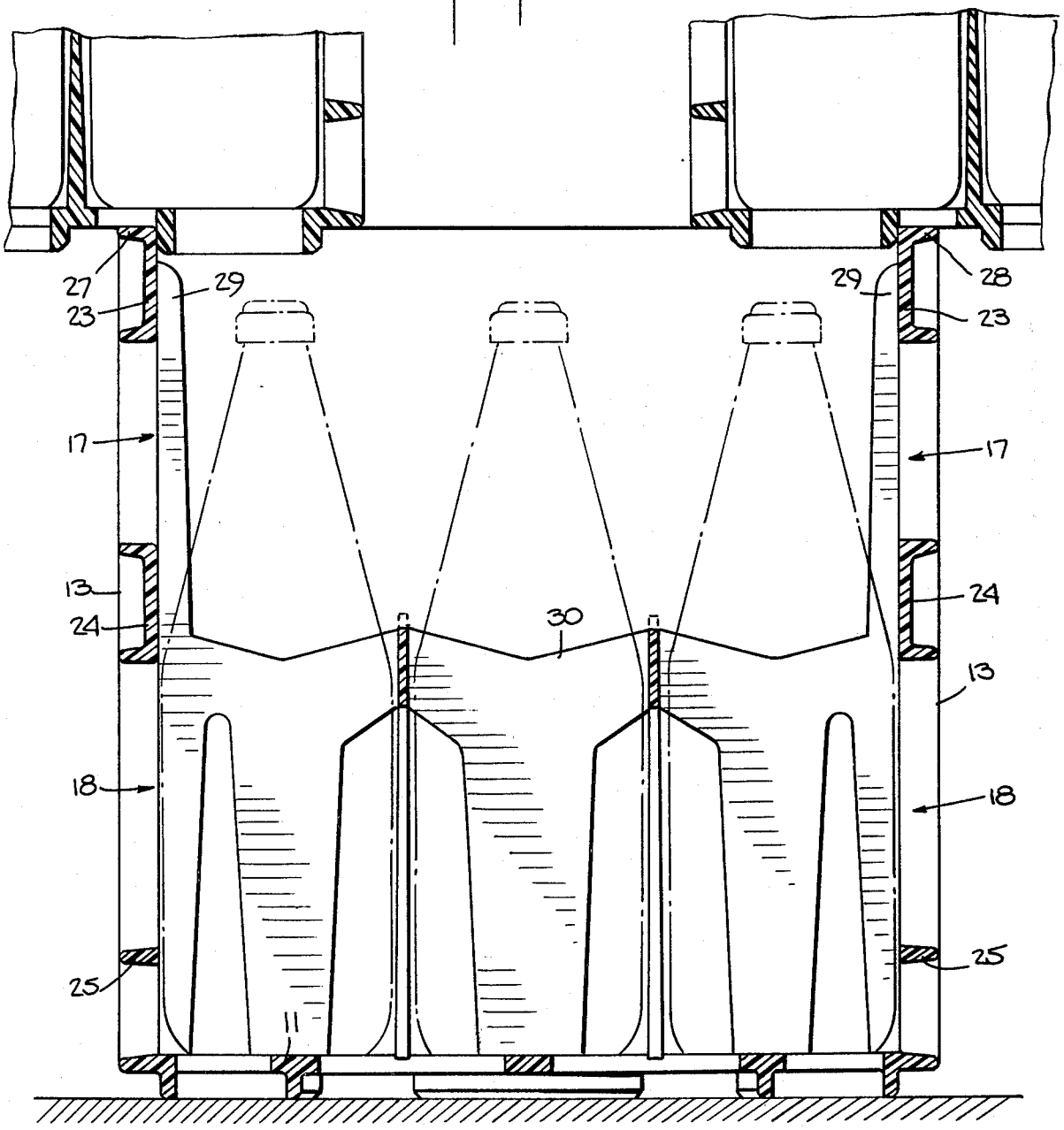
FIG. 5 is a sectional elevation view taken on line 5—5 of FIG. 1 and including fragmentary portions of two additional cases to illustrate the interlocking effect of criss-cross stacking.

Referring to FIGS. 1, 2 and 5, a unitary full depth open top beverage case 10 includes a bottom 11, a pair of end panels 12, and a pair of side panels 13. At the junctions of the end panels and side panels, strengthening column members 14 extend from the bottom to the top of the case to form the four vertical corners.

The side and end panels are provided with windows to permit a clear view of the bottles inside the case. Each end panel has preferably an upper window 15 and a lower window 16. Similarly, each side panel has an upper window 17 and a lower window 18. The height and vertical extent of the upper and lower windows coincide with the positions of the usual labels on the necks and sides of the bottles, respectively; so that all information as to their contents can be seen clearly.

The windows extend the full width of each panel; so that the panels have three principal horizontal sections. The upper and center sections of each end panel are formed by channel members 19 and 20, respectively, while the lower section is defined by a rail 21 and two spaced vertical posts 22 extending from the bottom of the case to the rail. The side panels are similarly formed by upper and center channel members 23 and 24, respectively, and lower rail 25 and vertical posts 26. The channel members combine vertical strength and horizontal stiffness with light weight, and the top flanges 27 and 28 of upper channel members 19 and 23, respectively, provide a continuous upper stacking rim for the beverage case. The lower rails and posts provide an open construction that prevents accumulation of dirt and debris in the bottom of the case and facilitates washing and drying of the case before reuse.

Although the U-shaped channel cross section of the upper panel members provides relatively high strength and stiffness, the requirement of criss-cross palletizing places heavy vertical loads on the stacking rims of the side panels intermediate their ends. An important feature of the present case construction, therefore, is the provision of interior vertical strengthening ribs 29 and spaced positions extending inwardly from each side panel and running from the bottom of the case to terminate just below the upper stacking rim. These ribs are preferably tapered and buttress the side panels against lateral loads as well as providing direct support to the bottom of cases stacked above, as shown clearly in FIG. 5. These ribs thus transfer the vertical load to the bottom of the case, thereby preventing failure of the top side section due to excessive loading.

The vertical strengthening ribs are preferably integrated with and form vertical extensions of lateral interior walls 30 which, together with longitudinal interior walls 31, form criss-cross partitions extending upward less than half the height of the case to provide bottle-receiving compartments within the case. The illustrated arrangement has three lateral and two longitudinal partitions to create twelve compartments for one dozen beverage bottles. As shown in FIG. 2, the center lateral partition 30 serves as a third interior strengthening rib disposed between the ribs 29 and extending upwardly from the bottom of the case to terminate below the upper window in the side panel.

Figure 3:
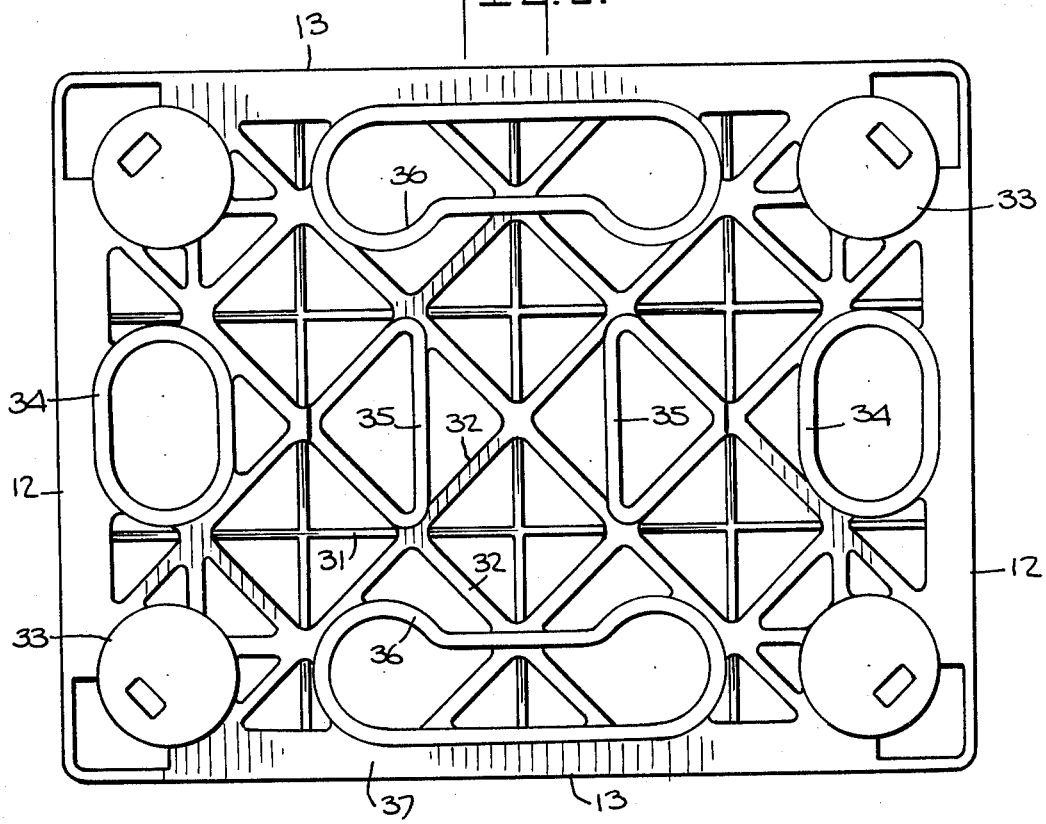
FIG. 3 is a plan view of the exterior of the bottom of the case of FIG. 1.
Figure 4:
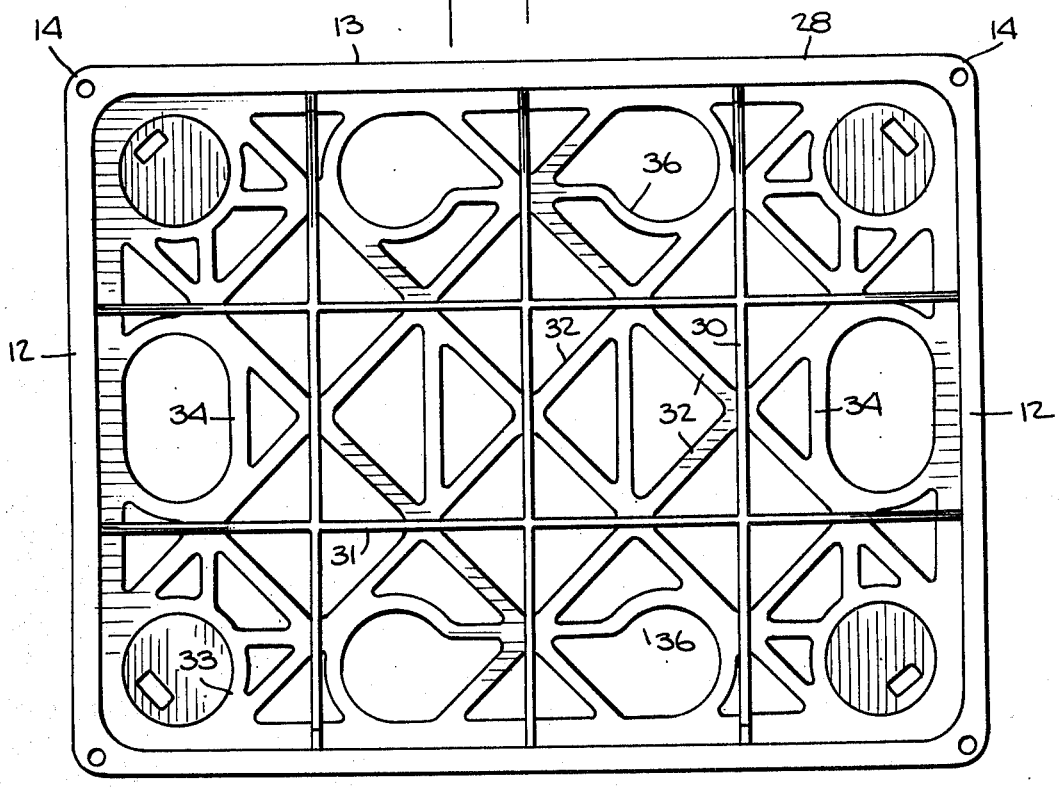
FIG. 4 is a plan view of the interior of the case of FIG. 1.

Referring next to FIGS. 3 and 4, the bottom of the case is formed by diagonal criss-cross members 32 that intersect at the midpoints of the bottoms of partition walls 30 and 31 to form a triangular grillwork of great strength and rigidity, yet light in weight and open to permit air to circulate and prevent the accumulation of dirt or liquid in the case.

As shown most clearly in FIG. 3, the outside of the case bottom has a number of extensions or protrusions in the form of circular bosses 33, oval frames 34, triangular frames 35, and dumbbell shaped frames 36. The shapes of these protrusions are more or less arbitrary, but it is important that they be spaced in rows and columns to form a pair of spaced lateral channels and a pair of spaced longitudinal channels inboard of the ends and sides of the case, respectively. The width of these channels is equal to twice the width of the upper stacking rims of the cases; so that the protrusions will provide locking engagement between adjacent layers of cases in criss-cross stacking arrangements, as will be described in connection with FIGS. 8 and 9.

The circular bosses 33 are placed at the corners of the pattern of protrusions, and the outer margin of the pattern is spaced inboard from the sides of the case to provide a continuous lower stacking rim 37 equal in width to upper stacking rim 28. This arrangement permits these cases also to be lockingly stacked one directly above another, if desired.

Figure 6:
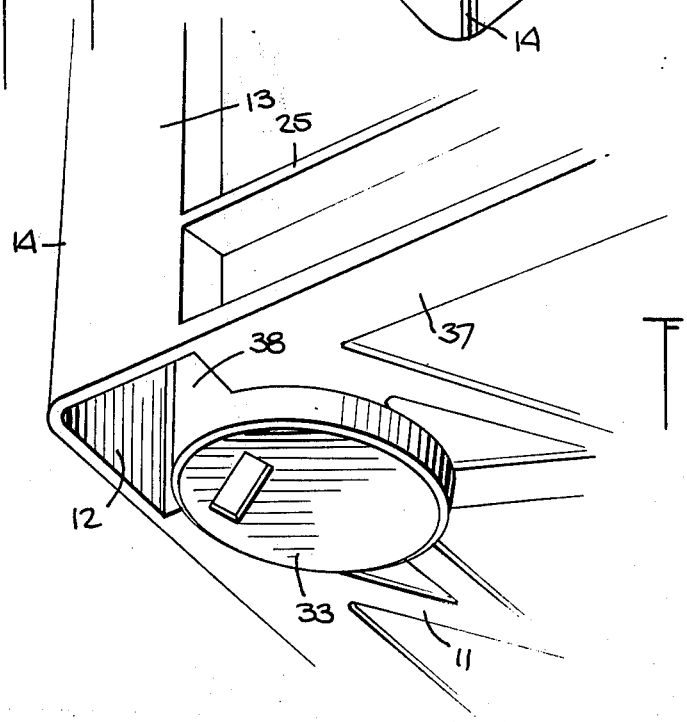
FIG. 6 is a fragmentary perspective view of a bottom corner of the case of FIG. 1 showing a hollow corner column member of approximately triangular cross section.
Figure 7:
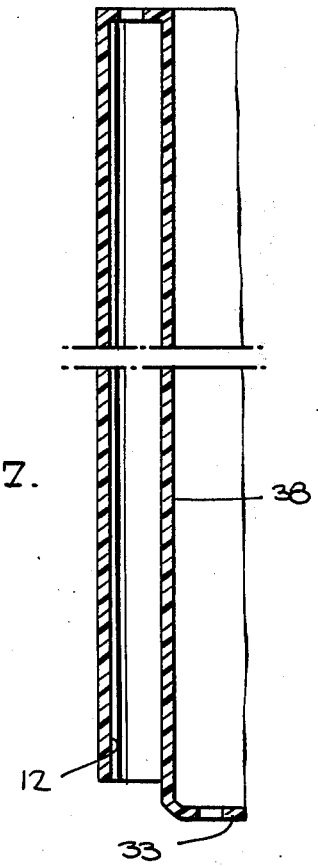
FIG. 7 is a sectional elevation view taken on line 7—7 of FIG. 1 to illustrate the hollow, double wall construction of the corner column member.

Referring to FIGS. 6 and 7, the corner column members 14 form another important feature of the full depth case of the present invention by contributing substantially to its strength and rigidity without exacting a penalty in excess weight. These advantages are achieved by making each column member hollow and of substantially triangular cross section. The sides of the triangle are formed by lateral margins of adjacent side and end panels at each corner of the case, and the base of the triangle is formed by the vertically extended sector of the side wall 38 of each corresponding circular boss 33 that connects the adjacent side and end walls.

The above described case construction is ideally suited to forming as a unitary structure of molded high impact strength plastic material, such as high density polyethylene or other suitable plastics. By making the case as a monolithic structure, every component contributes a maximum amount to the strength and rigidity of the total case; also the plastic material provides an attractive appearance and is easily cleaned.

Figure 8:
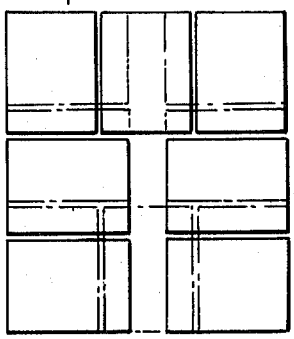
FIG. 8 is a diagrammatic plan view of a criss-cross stacking arrangement of seven cases per layer.
Figure 9:
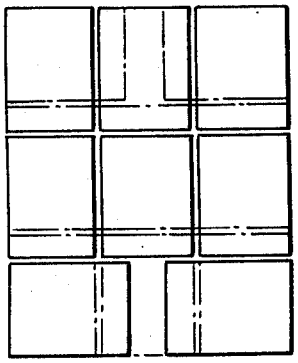
FIG. 9 is a diagrammatic plan view of a criss-cross stacking arrangement of eight cases per layer.

FIGS. 8 and 9 illustrate diagrammatically two possible criss-cross stacking arrangements, one with seven cases per layer and the other with eight cases per layer, using cases having bottom protrusions patterned similarly to FIG. 3. In each figure the arrangement of the cases alternates from layer to layer, with the arrangement in the lower layer shown by dashed lines and in the upper layer by solid lines.

In FIG. 8, three cases are set side by side, and then two cases are set end to end at right angles to the first three, with their sides contiguous to the ends of the three cases and with their outboard ends even with the outboard sides of the first three cases. The final two cases of the first layer are then set side by side with the respective second two cases. For the next layer, the pattern is repeated, but rotated by 180 degrees.

Since one dozen-bottle cases have the width of ends to sides in the ratio of three to four, there will be a gap between the inboard ends of the last four cases, but the interlocking provided by the bottom protrusions creates a stable and rigid stack, even if piled several layers high.

In FIG. 9, a first set of three cases is set side by side, a second set of three cases is set side by side, with their ends contiguous to respective ends of the three cases of the first set, and then two cases are set end to end at right angles to the cases of the first and second sets, with their sides contiguous to the outboard ends of one of the first two sets. The second layer then repeats the arrangement of the first but, again, rotated by 180°.

Each of the foregoing stacking arrangements locks contiguous sides and ends of the cases in one layer within the lateral or longitudinal channels formed between rows or columns of the bottom protrusions of the cases in the layer above, in the same manner as taught in my above-mentioned U.S. Pat. No. 3,568,879. The beverage case of the present invention, however, provides the additional advantage of full label visibility for the bottles contained therein without any sacrifice of strength or rigidity.

I claim:

1. A unitary molded plastic full depth rectangular beverage case comprising:

a flat bottom formed of spaced criss-cross intersecting strips;

two side panels, each panel including a horizontal elongated lower member joined to a corresponding side of the bottom, a horizontal elongated intermediate member spaced above the lower member to create a lower window opening therebetween, and a horizontal elongated upper member spaced above the intermediate member to create an upper window opening therebetween;

two end panels, each panel including a lower member joined to a corresponding end of the bottom, an intermediate member and an upper member spaced to create lower and upper window openings in horizontal alignment with the window openings in the side panels;

hollow corner column members of approximately triangular cross section rigidly joining adjacent ends of each side panel and end panel, said column members forming the ends of the upper and lower window openings of the side and end panels;

a continuous upper stacking rim formed by the tops of the upper side and end panel members and the tops of the corner column members;

spaced protrusions on the exterior of said bottom arranged in rows to define lateral channels therebetween, said lateral channels being approximately twice the width of said upper stacking rim and adapted to lockingly engage the upper stacking rims of two other cases when said case is stacked in criss-cross fashion thereupon, the protrusions being inset from the side and end edges of the bottom to provide a lower stacking rim around the margin of said bottom that is congruent with said upper stacking rim; and spaced longitudinal and lateral integrally formed partitions within said case for dividing the interior into a predetermined number of bottle-receiving compartments, the lateral partitions nearest the lateral channels defined between said rows of bottom protrusions having rib-like portions at each end extending upwardly from the bottom and terminating below the top of the respective side panels, to avoid interference with the bottom protrusions of another case stacked thereabove, and integrally attached to the lower, intermediate, and upper members of said side panels, said ribs providing both vertical and lateral support to the tops of the side panel upper members to resist crushing thereof when a plurality of cases are stacked in criss-cross arrangement, without obstructing the view of bottles in the interior of the case.

2. A unitary molded plastic full depth rectangular beverage case comprising:

a flat bottom formed of spaced criss-cross intersecting strips;

two side panels, each panel including a horizontal elongated lower member joined to a corresponding side of the bottom, a horizontal elongated flanged intermediate member spaced above the lower member to create a lower rectangular window opening therebetween, and a horizontal elongated flanged upper member spaced above the intermediate member to create an upper rectangular window opening therebetween;

two end panels, each panel including a lower member joined to a corresponding end of the bottom, an intermediate flanged member and an upper flanged member spaced to create lower and upper rectangular window openings in horizontal alignment with the window openings in the side panels;

hollow corner column members of approximately triangular cross section, open at the bottoms thereof and rigidly joining adjacent ends of each side panel and end panel, said column members forming the ends of the upper and lower window openings of the side and end panels;

a continuous upper stacking rim formed by the top flanges of the upper side and end panel members and the tops of the corner column members;

spaced protrusions of the exterior of said bottom arranged in rows to define lateral channels therebetween, said lateral channels being approximately twice the width of said upper stacking rim and adapted to lockingly engage the upper stacking rims of two other cases when said case is stacked in criss-cross fashion thereupon, the protrusions being inset from the side and end edges of the bottom to provide a lower stacking rim around the margin of said bottom that is congruent with said upper stacking rim; and spaced longitudinal and lateral integrally formed partitions within said case for dividing the interior into a predetermined number of bottle-receiving compartments, the lateral partitions nearest the lateral channels defined between said rows of bottom protrusions having rib-like portions at each end extending upwardly from the bottom and terminating below the top of the respective side panels to avoid interference with the bottom protrusions of another case stacked thereabove, and integrally attached to the lower, intermediate, and upper members of said side panels, said ribs providing both vertical and lateral support to the tops of the side panel upper members to resist crushing thereof when a plurality of cases are stacked in criss-cross arrangement, without obstructing the view of bottles in the interior of the case.

3. A unitary molded plastic full depth rectangular beverage case comprising:

a flat bottom formed of spaced criss-cross intersecting strips;

two side panels, each panel including a horizontal elongated lower member joined to a corresponding side of the bottom, a horizontal elongated outwardly facing U-channel intermediate member spaced above the lower member to create a lower rectangular window opening therebetween, and a horizontal elongated outwardly facing U-channel upper member spaced above the intermediate member to create an upper window opening therebetween;

two end panels, each panel including a lower member joined to a corresponding end of the bottom, an intermediate U-channel member and an upper U-channel member spaced to create lower and upper rectangular window openings in horizontal alignment with the window openings in the side panels;

hollow corner column members of approximately triangular cross section, open at the bottom thereof and rigidly joining adjacent ends of each side panel and end panel, said column members forming the ends of the upper and lower window openings of the side and end panels;

a continuous upper stacking rim formed by the top flanges of the upper side and end panel members and the tops of the corner column members;

spaced protrusions on the exterior of said bottom arranged in rows to define lateral channels therebetween, said lateral channels being approximately twice the width of said upper stacking rim and adapted to lockingly engage the upper stacking rims of two other cases when said case is stacked in criss-cross fashion thereupon, the protrusions being inset from the side and end edges of the bottom to provide a lower stacking rim around the margin of said bottom that is congruent with said upper stacking rim; and spaced longitudinal and lateral integrally formed partitions within said case for dividing the interior into a predetermined number of bottle-receiving compartments, the lateral partitions nearest the lateral channels defined between said rows of bottom protrusions having rib-like portions at each end extending upwardly from the bottom and terminating below the top of the respective side panels to avoid interference with the bottom protrusions of another case stacked thereabove, and integrally attached to the lower, intermediate, and upper members of said side panels, said ribs providing both vertical and lateral support to the tops of the side panel upper members to resist crushing thereof when a plurality of cases are stacked in criss-cross arrangement, without obstructing the view of bottles in the interior of the case.

* * * * *